US005600864A

United States Patent [19]

Huber

[11] Patent Number: 5,600,864

[45] Date of Patent: Feb. 11, 1997

[54] REVERSIBLE BACK SCRUBBER

[76] Inventor: Lloyd Huber, 1606-13353 108th Avenue, Surrey, British Columbia, Canada, V3T 5T5

[21] Appl. No.: 557,387

[22] Filed: Nov. 13, 1995

[51] Int. Cl.[6] ..... A47K 7/02

[52] U.S. Cl. ..... 15/118; 15/160; 15/210.1; 15/244.1; 15/244.3; 4/606; 601/136

[58] Field of Search ..... 15/118, 160, 210.1, 15/215–217, 244.1, 244.3; 4/606; 601/136

[56] References Cited

U.S. PATENT DOCUMENTS

| | | | |
|---|---|---|---|
| 1,954,940 | 4/1934 | Mikel | 15/244.3 |
| 3,040,337 | 6/1962 | Fjelstad | 15/160 |
| 3,750,226 | 8/1973 | Morgan | 15/244.1 |
| 4,047,259 | 9/1977 | Lotis | 15/244.3 |
| 4,417,362 | 11/1983 | Walker | 15/160 |
| 4,696,068 | 9/1987 | Kenner | 15/210.1 |
| 4,890,352 | 1/1990 | Stowers et al. | 15/244.1 |
| 4,943,018 | 7/1990 | Glaser et al. | 15/160 |
| 5,175,896 | 1/1993 | Zamir | 15/160 |
| 5,228,165 | 7/1993 | Westberry et al. | 15/160 |
| 5,277,389 | 1/1994 | Ballares et al. | 248/206.3 |
| 5,311,635 | 5/1994 | Moore | 15/244.3 |
| 5,312,666 | 5/1994 | Jovanovic | 428/76 |

FOREIGN PATENT DOCUMENTS

| | | | |
|---|---|---|---|
| 3939622 | 1/1991 | Germany | 15/160 |
| 563146 | 6/1975 | Switzerland | 15/210.1 |
| 2209933 | 6/1989 | United Kingdom | 15/210.1 |
| 2216000 | 10/1989 | United Kingdom | 15/210.1 |
| 2253142 | 9/1992 | United Kingdom | 15/244.1 |

*Primary Examiner*—Mark Spisich
*Attorney, Agent, or Firm*—Norman M. Cameron

[57] ABSTRACT

A back scrubber includes a reversible cleaning pad having two sides. Each side has a different type of cleaning surface. There is a mechanism for selectively and releasably connecting the pad to a wall of a shower stall so that either side can face outwardly. The mechanism may include suction cups. The suction cups may be on both sides of the pad. Alternatively, the pad may have suction cup connectors accessible from both sides. The suction cups are then releasably connectible to the connectors on either side of the pad.

8 Claims, 1 Drawing Sheet

REVERSIBLE BACK SCRUBBER

BACKGROUND OF THE INVENTION

Properly scrubbing a person's back during a shower is a difficult operation to perform alone. Even people with normal degrees of joint articulation find it hard to reach all of the areas of the back. However this is even more difficult for people with arthritis or other disabilities limiting arm movement.

As a result, various devices have been developed to aid in proper cleaning of the back. Ordinary back brushes are better suited for a bathtub than a shower because they tend to clutter the shower stall. Earlier patents disclose the concept of back scrubbers which can be removably attached to a shower stall. One example is found in U.S. Pat. No. 5,311,635 to Moore. This patent shows a back cleaning apparatus including a sponge-like layer, an exterior layer of indoor/outdoor carpet and a backer board which can be releasably affixed to a shower stall by suction cups.

Another such device as shown in the U.S. Pat. No. 5,277,389. This again shows the use of suction cups to releasably connect a back scrubber to the wall of a shower stall. The cleaning surface is a replaceable sponge.

One problem associated with such prior art devices is that different textures of cleaning surfaces are desired by different people and for different purposes. For ordinary cleaning, for example, a sponge may be perfectly suitable. However, more intense cleaning requires a somewhat rougher surface. This may also be desirable for someone who wants relieve itching on the back by rubbing against a rough object. Prior art devices of the type mentioned do not readily allow the user to change the nature or roughness of the cleaning surface as desired.

Accordingly, it is an object of the invention to provide an improved back scrubber which can allow the user to choose one of two different cleaning or scrubbing surfaces as desired.

It is also an object of the invention to provide an improved back scrubber which is simple and rugged in construction and economical to produce and sell.

It is a further object of the invention to provide an improved back scrubber which can be securely connected to the wall of a shower and yet easily re-configured to offer different scrubbing or cleaning surfaces.

SUMMARY OF THE INVENTION

In accordance with these objects, there is provided a back scrubber comprising a reversible cleaning pad having two sides. Each side has a different type of cleaning surfaces. There is means for selectively and releasably connecting the pad to a wall of a shower stall so that either said side can face outwardly.

For example, the means may include suction cups.

In one example, the suction cups are on both sides of the pad.

On another example the pad has suction cup connectors accessible from both sides of the pad. The suction cups are releasably connectible to the connectors on either side of the pad. The connectors may be, for example, eyelets.

DESCRIPTION OF THE PREFERRED EMBODIMENTS

Figure 1:
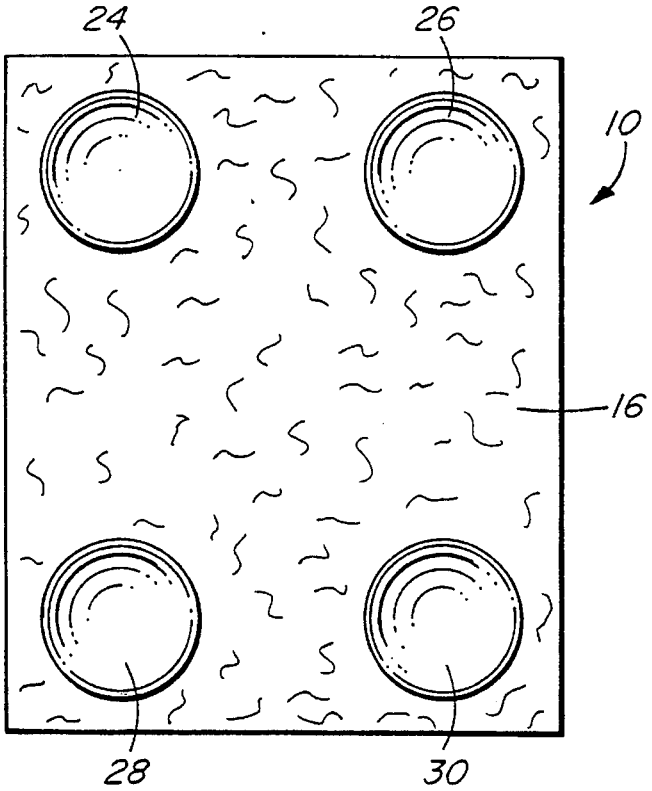
FIG. 1 is a from elevation of a reversible back scrubber according to an embodiment of the invention.
Figure 2:
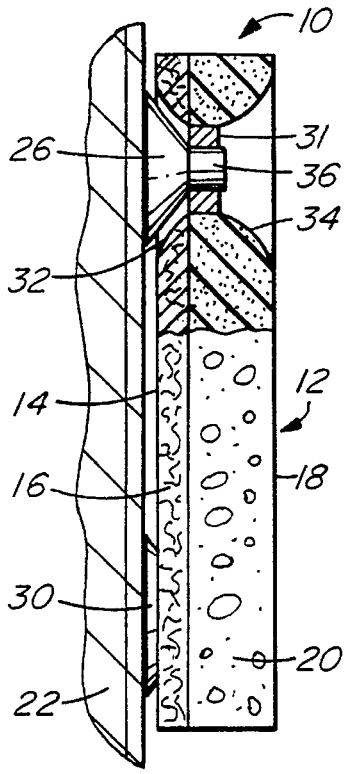
FIG. 2 is a side elevation thereof mounted on a shower stall and with a portion thereof broken-away.

Referring to the drawings, FIG. 1 and 2 show a back scrubber 10 according to a first embodiment of the invention. The back scrubber includes a rectangular pad 12 which is similar in structure to available cleaning pads for dishes and utensils in this particular embodiment. The pad has a first side 14 forming the exterior of a first member 16. In this example the first member is of an abrasive, fibrous material. The pad has a second side 18 forming the exterior of a second member 20 which is bonded to the first member. The member 20 in this example is of synthetic sponge.

The back scrubber 10 also has means for Selectively and releasably connecting the pad to a wall 22 of a shower stall as shown in FIG. 2. This means includes four suction cups 24, 26, 28 and 30 as shown in FIG. 1.

The pad also has suction cup connectors accessible from both sides of the pad in the form of a plurality of eyelets 31. Only one of these is shown, but there is an eyelet 31 for each of the four suction cups. The eyelets are crimped in place over apertures in the pad 12 so as to form dimples 32 and 34 on the two sides of the pad. In this particular example suction cup 26 is illustrated in dimple 32. Each suction cup has a shank 36 which extends through one of the eyelets 31. The eyelets are of a size and shape such that they grippingly receive the shanks. In this particular example, both the shank and eyelet are circular in section.

In the position illustrated in FIG. 2, the second surface 18, being the relatively soft side of sponge, faces outwardly from the wall 22. However the pad can be reversed so that the first, more abrasive side 14 faces outwardly simply by pulling the pad off of the shanks 36 of the suction cups. The pad can then be reversed and the eyelets 31 pressed over the shanks of the suction cups again so that the side 14 faces outwardly instead.

Figure 3:
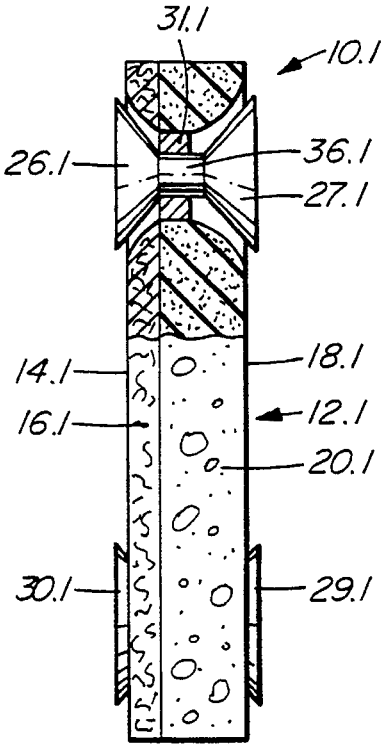
FIG. 3 is a side elevation of a reversible back scrubber according to another embodiment of the invention and partly broken away.

An alternative embodiment is shown in FIG. 3. Like parts have like numbers with the additional designation "0.1". The back scrubber 10.1 has a reversible cleaning pad 12.1 which is identical to pad 12 in this example. However the suction cups are different in that they are arranged in pairs. For example, suction cup 26.1 and another suction cup 27.1 form a pair of suction cups on opposite sides of the pad. They are connected together by a common shank 36.1. Likewise, suction cup 30.1 has a corresponding suction cup 29.1 on the opposite side of the pad. In this example, the back scrubber is reversed by pulling the suction cups off of the wall of the shower enclosure. The pad is then reversed and the suction cups on the opposite side of the pad are affixed to the wall of the shower.

Other variations of the invention include a brush-like member on one side or both sides of the pad.

It will be understood by someone skilled in the an that many of the features described above are by way of example only and are not intended to limit the scope of the invention which is to be interpreted with reference to the following claims.

What is claimed is:

1. A back scrubber, comprising:

a reversible cleaning pad having two sides, each said side having a different type of cleaning surface; and means for selectively and releasably connecting the pad to a wall of a shower stall so that either said side can face outwardly, said means including suction cups.

2. A back scrubber as claimed in claim 1, wherein the suction cups are on both sides of the pad.

3. A back scrubber as claimed in claim 2, wherein the suction cups are connected together in pairs extending through the pad, each said pair having a suction cup on each said side of the pad.

4. A back scrubber as claimed in claim 1, wherein the pad has suction cup connectors accessible from both said sides, the suction cups being releasably connectible to the connectors on either said side of the pad.

5. A back scrubber as claimed in claim 4, wherein the suction cups have shanks and the connectors have sockets which grippingly receive the shanks.

6. A back scrubber as claimed in claim 5, wherein the connectors are eyelets extending through the pad.

7. A back scrubber, comprising:

a reversible, resilient cleaning pad having opposite first and second sides with opposite first and second cleaning surfaces respectively, the first surface being rougher than the second surface;

a plurality of eyelets crimped over apertures in the pad; and a plurality of suction cups, each said suction cup having a shank releasably engageable with one of the eyelets on each said side of the pad.

8. A back scrubber as claimed in claim 7, the first said surface being an abrasive member and the second said surface being a natural or artificial sponge.

* * * * *